United States Patent [19]

Jallouk

[11] 4,032,873

[45] June 28, 1977

[54] FLOW DIRECTING MEANS FOR AIR-COOLED TRANSFORMERS

[75] Inventor: Philip A. Jallouk, Oak Ridge, Tenn.

[73] Assignee: The United States of America as represented by the United States Energy Research and Development Administration, Washington, D.C.

[22] Filed: May 21, 1976

[21] Appl. No.: 688,871

[52] U.S. Cl. ..... 336/57; 336/59; 336/60

[51] Int. Cl.[2] ..... H01F 27/08

[58] Field of Search ..... 336/55, 57, 58, 59, 336/60

[56] References Cited

UNITED STATES PATENTS

| | | | |
|---|---|---|---|
| 2,388,566 | 11/1945 | Paluev | 336/60 X |
| 2,459,322 | 1/1949 | Johnston | 336/60 X |
| 2,632,041 | 3/1953 | Bilodeau | 336/60 X |
| 2,751,562 | 6/1956 | Camilli et al. | 336/60 |
| 2,942,213 | 6/1960 | Camilli et al. | 336/57 X |
| 3,548,354 | 12/1970 | Schwab | 336/57 |
| 3,902,146 | 8/1975 | Muralidharan | 336/60 X |

*Primary Examiner*—Thomas J. Kozma
*Attorney, Agent, or Firm*—Dean E. Carlson; Stephen D. Hamel; Fred O. Lewis

[57] ABSTRACT

This invention relates to improvements in systems for force-cooling transformers of the kind in which an outer helical winding and an insulation barrier nested therein form an axially extending annular passage for cooling-fluid flow. In one form of the invention a tubular shroud is positioned about the helical winding to define an axially extending annular chamber for cooling-fluid flow. The chamber has a width in the range of from about 4 to 25 times that of the axially extending passage. Two baffles extend inward from the shroud to define with the helical winding two annular flow channels having hydraulic diameters smaller than that of the chamber. The inlet to the chamber is designed with a hydraulic diameter approximating that of the coolant-entrance end of the above-mentioned annular passage. As so modified, transformers of the kind described can be operated at significantly higher load levels without exceeding safe operating temperatures. In some instances the invention permits continuous operation at 200% of the nameplate rating.

2 Claims, 3 Drawing Figures

FLOW DIRECTING MEANS FOR AIR-COOLED TRANSFORMERS

BACKGROUND OF THE INVENTION

This invention was made in the course of, or under, a contract with the United States Energy Research and Development Administration.

This invention relates generally to electrical power transformers which are cooled by passage of a cooling fluid therethrough, and more particularly to an improved force-cooled transformer system.

One kind of commercially available power transformer comprises a closed-loop core having a plurality of vertically extending legs, each of which is encompassed by a nested array of insulated windings and insulation barriers. The components of the array are spaced one from another to form axial passages for a cooling fluid and are arranged in the following order, beginning with the components closest to the core: An insulation barrier, at least one secondary winding in the form of an open-ended cylinder, another insulation barrier, and a helical primary winding. Heat generated during operation of the transformer is removed by passing streams of a suitable fluid (e.g., air or oil) axially along the outside of the primary winding as well as through the internal axial passages of the array.

Transformers of the kind just described are subject to the disadvantage that the maximum permissible operating temperature of the primary winding is comparatively low. That is, as the transformer load is increased above a certain value, the temperature of the primary increases to a value where the insulation for the primary degrades or fails. Although normally there is some heat transfer due to turbulence between the streams of cooling fluid and the stagnant-fluid pockets between the turns of the primary, such interchange is not large, and is strongly affected by geometry.

Certain attempts have been made to uprate transformers of the kind described by improving the heat transfer between the primary winding and the cooling fluid. In one such attempt, two annular plates composed of insulating material have been fitted snugly about either end of the primary, these plates extending radially outward to the walls of the cabinet housing the transformer. The resulting chamber defined by the plates, cabinet, and primary winding typically has a width of at least 50 times the width of the aforementioned axial passage defined by the inner face of the primary and the adjacent insulation barrier. Such an arrangement does not effect an appreciable increase in cooling. In another approach, an open-ended cylinder of uniform diameter has been mounted about the primary winding to form a narrow annular passage with the winding and thus promote turbulent flow of the cooling fluid flowing axially through this passage. In general, this approach is effective only if the spacing between the turns of the primary winding is small.

SUMMARY OF THE INVENTION

It is, therefore, an object of this invention to provide an improved force-cooled transformer system characterized by improved heat transfer to the cooling medium.

It is another object to provide a force-cooled transformer system permitting uprating of transformers of the type having an outer winding with openings between the turns thereof.

It is another object to provide an improved system for force-cooling a transformer having an outer helical winding, the improved system being designed to promote transverse flow of a cooling fluid through the openings of the helical winding.

The invention may be summarized as follows: In a system including a transformer having an axis and means for circulating cooling fluid through passages in said transformer extending in the general direction of said axis, said transformer including an inner winding, an outer winding having openings between turns thereof, and an intermediate electrically non-conductive barrier all in nested relation about said axis, said barrier defining with said outer winding an axial passage for receiving a first input stream of said cooling fluid, the improvement comprising: means encompassing said outer winding to form therewith an axially extending chamber for cooling-fluid flow; an inlet for said chamber for introducing thereto a second input stream of said cooling fluid, said inlet extending about said axis; and a cooling-fluid outlet for said chamber, said outlet being spaced axially from said inlet and extending about said axis, at least one of said inlet and outlet having a hydraulic diameter smaller than the hydraulic diameter of said chamber.

The drawings are not to scale.

DESCRIPTION OF THE PREFERRED EMBODIMENT

This invention is generally applicable to force-cooled transformers having an exterior winding, or coil which extends about an axis and has transverse openings therein. For convenience, the invention will be illustrated as utilized in the uprating of a conventional transformer coil-and-core assembly.

Figure 1:
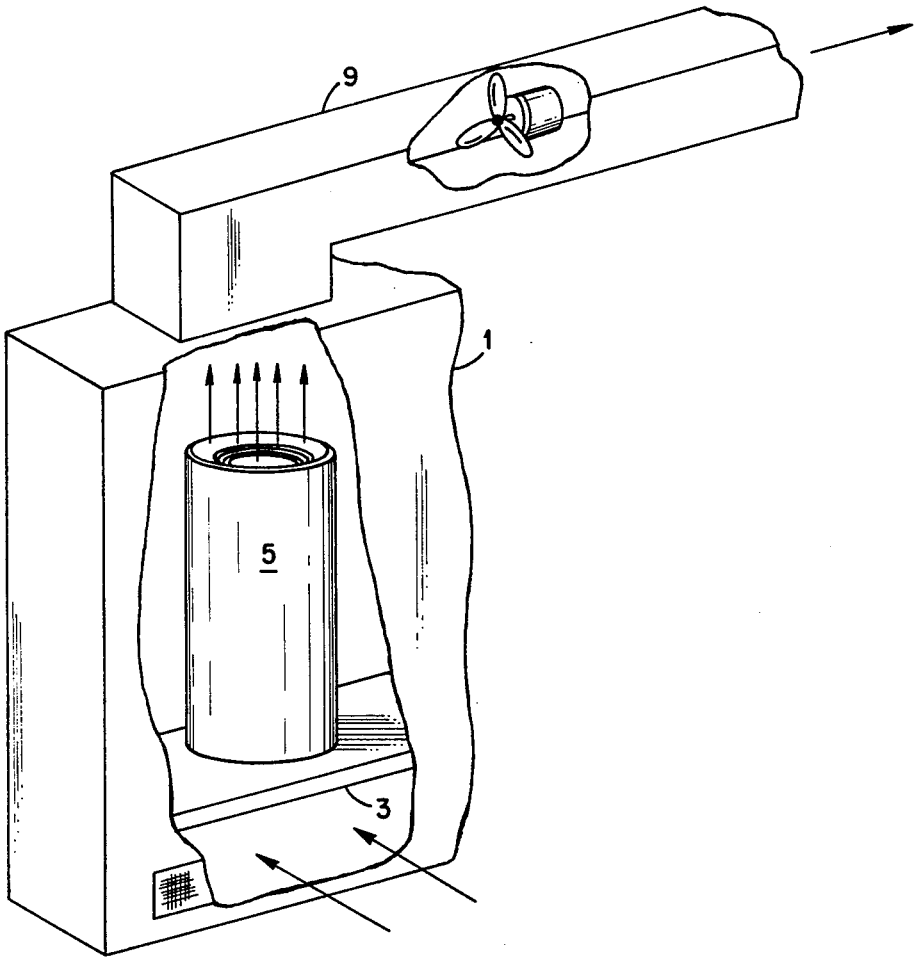
FIG. 1 is a schematic diagram of a system designed in accordance with this invention.

Referring to FIG. 1, the invention is illustrated generally in terms of a conventional cabinet 1, or housing which is partitioned into a lower and upper compartment by an electrically non-conductive support plate 3. As indicated, the lower compartment is vented to atmosphere. Mounted on the plate 3 is an electrically non-conductive, tubular shroud 5 of substantially uniform diameter. The interior of the shroud is in communication with a porous central section of the plate 3. As will be described, the shroud encompasses one of the coil-and-core assemblies—i.e., one phase—of a conventional three-phase transformer. As shown, any suitable means 7, such as a standard blower, is connected to draw cooling air into the lower compartment of the cabinet and then through the plate 3, the shroud 5, and an outlet header 9.

Figure 2:
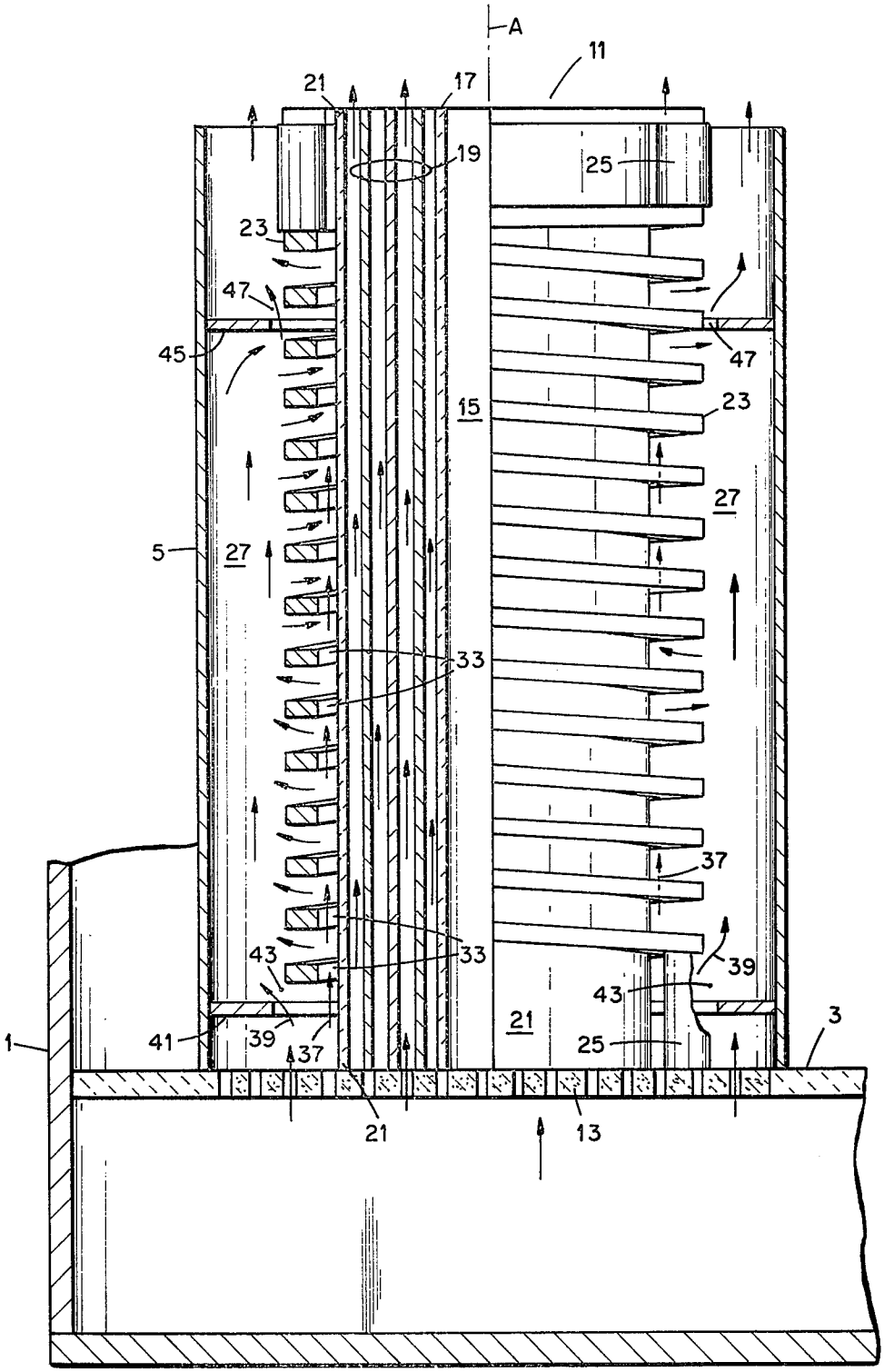
FIG. 2 is a front view, partly in section, of part of the system shown in FIG. 1.

Referring to FIG. 2, a conventional transformer coil assembly 11 is mounted on the porous section 13 of the plate 3 and is encompassed by the shroud. The coil assembly comprises a plurality of nested annular components which have a common axis A, which are spaced one from another, and encompass a central opening 15 for accommodating a leg of the transformer core (not shown). These components are arranged in the following order, beginning with the innermost: an insulation barrier 17; a secondary winding in the form of three tubular coils 19; another insulation barrier 21; and a helical primary winding 23, mounted on a circular array of insulating blocks 25. A similar array of insulating blocks is provided at the top end of the primary. As indicated by arrows, the annular, axially extending passages between the various components of assembly 11 constitute flow channels for air drawn through the plate 3, as described. For instance, an annular passage 33 defined by the outer face of barrier 21 and the inner face of the primary is a channel for an annular, upflowing stream of air designated as 37 in FIG. 2.

In accordance with this invention, the tubular shroud 5 is positioned about the helical primary 23 to form therewith an annular, axially extending chamber 27 having a width exceeding that of the passage 33. Preferably, the width of chamber 27 is in the range of from about 4 to 25 times that of the passage 33. Chamber 27 is in communication with the porous section of plate 3 and thus serves as a channel for receiving an annular stream of air designated as 39. Thus, the axial passage 33 and the chamber 27 receive different input streams of air from a common duct—i.e., the duct defined by the plate 3 and the lower ends of the shroud and barrier 21. In the illustrated embodiment, the shroud 5 is provided near its ends with axially spaced, annular internal flanges, or baffles, for restricting flow of air into and out of chamber 27. That is, the lower baffle 41 defines with the primary winding an annular gap, or inlet, 43 for the air stream 39, whereas the upper baffle 45 similarly defines an air outlet 47. Both the inlet 43 and outlet 47 extend completely about the axis A and are designed with hydraulic diameters smaller than the hydraulic diameter of chamber 27. By "hydraulic diameter" is meant four times the flow cross-sectional area divided by the wetted perimeter.

Providing the primary winding of the transformer with a shroud of the design just described markedly increases the cross-flow of cooling fluid through the openings in the primary winding. This is shown in the following example.

EXAMPLE

A transformer coil-and-core assembly similar to assembly 11 of FIG. 2 was provided with a shroud of the kind described above. The coil-and-core assembly was of commercial design (Transformer Model 7½ / 10 MVA, manufactured by Westinghouse Electric Corporation). The internally flanged shroud 5, which was composed of a plexiglass tube and plywood baffles, was disposed about the primary winding as shown in FIG. 2. The various dimensions were as follows:

| | |
|---|---|
| Internal diameter of shroud 5 | 37½" |
| Length of primary winding | 51⅞" |
| Length of chamber 27 | 40⅞" |
| Width of chamber 27* | 4" |
| Width of passage 33 | ⅜" |
| Width of inlet 43* | 1½" |
| Width of outlet 47* | 1¼"** |

*Hydraulic diameter is twice the width.
**Maximum value. As indicated in FIG. 2, in some regions the baffles extended close to an insulating block 25, defining a narrower gap therewith.

The cooling-fluid patterns in the resulting assembly were determined in tracer-injection tests conducted under adiabatic conditions, with the transformer de-energized. In these tests, the tracer (titanium tetrachloride) was mixed with a stream of air passed upward through the plate 3, and the resulting flow patterns were observed. The tests established that there were no coolant-starved regions between the turns of the primary winding. Instead, as indicated by arrows in FIG. 2, there was appreciable crossflow outward through the entire inlet section of the primary, this flow being from the passage 33 into the chamber 27, whereas there was appreciable inward crossflow through the entire outlet section of the primary, this flow being from the chamber 27 to the passage 33. In addition to such crossflow, there was continuous air inflow to the chamber 27 through inlet 39, as well as air outflow through the outlet 47.

A second series of tests was conducted with a standard three-phase transformer having a nameplate rating of 10 MVA. This transformer typically exhibits a temperature rise of approximately 80° C when operated continuously at rated load while being force-cooled with air. The transformer was modified as shown in FIG. 2 and in accordance with the foregoing table. Carefully conducted tests established that, with the same cooling conditions, the modified transformer could be operated continuously at approximately 200% of its rated load without exceeding a temperature rise of 80° C (air flow rate, 7000 CFM). Numerous other tests supported the finding that the invention provides a large and valuable improvement in the load level at which otherwise-standard helical-primary transformers can be operated.

While it will be understood that this invention is not limited to any particular theory of operation, presumably a significant improvement in crossflow of the cooling fluid is achieved with the invention because it builds up a pressure differential between chamber 27 and passage 33, the passage 33 being the higher pressure in the lower half of the assembly in the embodiment shown in FIG. 2. This is achieved by designing the inlet 43 and the inlet for passage 33 to have approximately the same average hydraulic diameters. This tends to equalize the flow in the two channels. Once beyond the baffle plate 41, the air entering through inlet 43 finds itself in a chamber which, due to the entrance and exit losses of plate 41, is at a considerably lower pressure than the passage 33. Consequently, there is a tendency for the air to flow radially outward. In addition, because the hydraulic diameter of passage 33 is considerably smaller than that of chamber 27, a greater pressure drop results in passage 33 than in chamber 27, for the same velocity. For equilibrium to occur, therefore, the velocity in passage 33 must be lower than in the chamber. This added force, which increases radial flow, is dependent on the hydraulic-diameter ratio.

Judicious choice must be made of the width ratio of chamber 27 to passage 33 for the particular problem at hand. Ratios of 4 to 1 or less are generally undesirable, since the entrance and exit losses due to baffle 41 would then be small, as would the velocity difference between channel 33 and chamber 27. On the other hand, ratios in excess of about 25 to 1 would also be undesirable, since the radial and axial flows would exist for only a short distance downstream of the coolant inlets before dropping off to almost zero in the half of the assembly immediately downstream of the coolant inlets.

Figure 3:
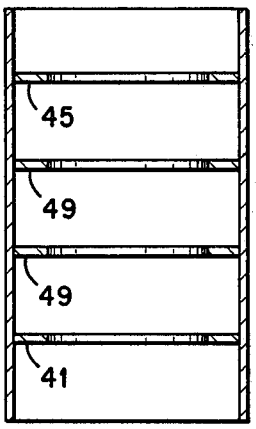
FIG. 3 is a schematic diagram of an alternative form of a shroud designated as 5 in FIGS. 1 and 2.

It will be apparent to those versed in the art that various modifications may be made in the embodiment shown in FIGS. 1 and 2 without departing from the principles of the invention. For instance, the lower baffle 41 need not be positioned upstream of the primary winding, as in FIG. 2, but may be positioned inward of the inlet end of the winding. If desired, both baffles may be mounted to the primary to snugly encompass the same, with the outer circumferences of the baffles defining annular gaps with the shroud 5 to provide the inlet and outlet for the chamber. In some instances, it may be desirable to provide one or more baffles 49 intermediate of the end baffles 41 and 43 of the chamber, as indicated in FIG. 3, with each baffle defining with the primary an annular channel for cooling-fluid flow, each channel having a hydraulic diameter smaller than that of the chamber 27. In some applications it may be satisfactory to employ only one baffle, such as the inlet baffle 41 or the outlet baffle 45; in that instance the unbaffled end of the shroud serves as either the inlet or the outlet for the chamber.

In the illustrative embodiment, the chamber 43 and outlet 47 are continuous annular channels. If desired, however, each may comprise a succession of spaced openings of orifices. In some instances it may not be expedient for the chamber inlet and outlet to completely encompass the axis A (FIG. 2). In general, the chamber inlet and outlet can be described as extending about the axis A, the term "about the axis" being used herein to include extending all of the way or part-way about the same.

In the foregoing description, it has been assumed that the cooling fluid is air, but it may be any other suitable medium such as argon or oil. The cooling fluid may be passed through the modified transformer assembly in either direction. The shroud and baffles may be composed of any suitable material which does not adversely affect performance of the transformer. Preferably, the shroud and chamber 27 are of circular section but this is not essential. The shroud 5 need not be of substantially uniform diameter. It may, for instance, be of frusto-conical configuration, in which instance the chamber 27 will vary in width from one end to the other. As applied to such a chamber, the term "width" as used herein will be understood to mean the average width, and the term "hydraulic diameter" to mean the average hydraulic diameter. The ends of the frusto-conical shroud will define annular channels with the primary winding, and these channels can serve as the cooling-fluid inlet and outlet for the chamber.

What is claimed is:

1. In a system including a transformer having an axis and means for circulating cooling fluid through passages in said transformer extending in the general direction of said axis, said transformer including an inner winding, an outer winding having openings between turns, and an intermediate electrically non-conductive barrier all in nested relation about said axis, said barrier defining with said outer winding an annular axial passage of substantially constant width, an end of said passage constituting an entrance for a first annular stream of said cooling fluid, the improvement comprising:

an electrically non-conductive imperforate tube encompassing said winding to form therewith an axially extending annular chamber for conveying an axially flowing stream of said cooling fluid, said chamber having a width in the range of from 4 to 25 times the width of said axial passage, and a baffle mounted within said chamber for defining with said outer winding an annular opening for cooling-fluid flow, said opening having a hydraulic diameter approximately equal to the hydraulic diameter of said passage.

2. In a system including a casing containing a transformer having an axis and means for circulating cooling fluid through passages in said transformer extending in the general direction of said axis, said transformer including an inner winding, an outer winding having a substantially constant diameter and having substantially equally spaced turns, and an intermediate electrically non-conductive barrier all in nested relation about said axis, said barrier defining with said outer winding an annular axial passage for receiving a first annular input stream of said cooling fluid, the improvement comprising:

an electrically non-conductive imperforate tube encompassing said outer winding to form therewith an axially extending annular chamber for conveying said cooling fluid, said chamber having a width in the range of from 4 to 25 times the width of said axial passage, a first annular baffle mounted in one end section of said chamber for defining with said outer winding an annular inlet for introducing to said chamber a second annular stream of said cooling fluid, said inlet having a hydraulic diameter approximately equal to the hydraulic diameter of said axial passage; and a second annular baffle mounted in the other end section of said chamber for defining with said outer winding an annular outlet for cooling-fluid outflow from said chamber, said outlet having a hydraulic diameter approximately equal to the hydraulic diameter of said inlet.

* * * * *